US009605568B2

(12) United States Patent
Lancon et al.

(10) Patent No.: US 9,605,568 B2
(45) Date of Patent: Mar. 28, 2017

(54) CYLINDER LUBRICANT FOR A TWO-STROKE MARINE ENGINE

(75) Inventors: Denis Lancon, Chassieu (FR); Valérie Doyen, Four (FR)

(73) Assignee: Total Marketing Services, Puteaux (FR)

( * ) Notice: Subject to any disclaimer, the term of this patent is extended or adjusted under 35 U.S.C. 154(b) by 425 days.

(21) Appl. No.: 14/111,684

(22) PCT Filed: Apr. 13, 2012

(86) PCT No.: PCT/EP2012/056812
§ 371 (c)(1),
(2), (4) Date: Oct. 14, 2013

(87) PCT Pub. No.: WO2012/140215
PCT Pub. Date: Oct. 18, 2012

(65) Prior Publication Data

US 2014/0041610 A1 Feb. 13, 2014

(30) Foreign Application Priority Data

Apr. 14, 2011 (FR) ..... 11 53276

(51) Int. Cl.
*C10M 159/20* (2006.01)
*F01M 7/00* (2006.01)
*C10M 163/00* (2006.01)

(52) U.S. Cl.
CPC ..... *F01M 7/00* (2013.01); *C10M 159/20* (2013.01); *C10M 163/00* (2013.01);
(Continued)

(58) Field of Classification Search
CPC C10M 133/02; C10M 159/20; C10M 159/22; C10M 159/24; C10M 163/00; F01M 7/00
See application file for complete search history.

(56) References Cited

U.S. PATENT DOCUMENTS

| | | | |
|---|---|---|---|
| 3,933,662 | A | 1/1976 | Lowe |
| 7,651,984 | B2 | 1/2010 | Cook et al. |
| 2008/0287329 | A1 | 11/2008 | Lancon et al. |
| 2010/0167969 | A1 | 7/2010 | Doyen et al. |
| 2011/0059877 | A1 | 3/2011 | Obiols et al. |

(Continued)

FOREIGN PATENT DOCUMENTS

| | | | | |
|---|---|---|---|---|
| FR | WO 2009153453 A2 * | 12/2009 | ..... | C10M 163/00 |
| WO | WO-2009153453 A2 | 12/2009 | | |

OTHER PUBLICATIONS

English Translation of the International Preliminary Report on Patentability, issued Oct. 15, 2013, incorporating the English Translation of the Written Opinion of the ISA, ISA/EP, Rijswijk, NL, mailed Sep. 7, 2012.

*Primary Examiner* — Jacob Amick
(74) *Attorney, Agent, or Firm* — Harness, Dickey & Pierce, P.L.C.

(57) ABSTRACT

A cylinder lubricant having a BN determined according to the standard ASTM D-2896 greater than or equal to 15 milligrams of potash per gram of lubricant, including: one or more lubricant base oils for marine engines, at least one detergent based on alkali or alkaline-earth metals, overbased with metallic carbonate salts, at least one neutral detergent, one or more oil-soluble alkoxylated fatty amines, having a BN determined according to the standard ASTM D-2896 comprised between 100 and 600 milligrams of potash per gram, where the percentage by mass of alkoxylated fatty amines with respect to the total weight of lubricant is chosen such that the BN provided by these compounds represents a contribution comprised between 2 and 8 milligrams of potash per gram of lubricant, and where the BN provided by the metallic carbonate salts represents a contribution of at the most 65%.

22 Claims, 1 Drawing Sheet

(52) U.S. Cl.
CPC ..... *C10M 2203/1006* (2013.01); *C10M 2207/021* (2013.01); *C10M 2207/027* (2013.01); *C10M 2207/028* (2013.01); *C10M 2207/10* (2013.01); *C10M 2207/144* (2013.01); *C10M 2207/26* (2013.01); *C10M 2207/262* (2013.01); *C10M 2207/281* (2013.01); *C10M 2207/282* (2013.01); *C10M 2215/04* (2013.01); *C10M 2215/042* (2013.01); *C10M 2219/044* (2013.01); *C10M 2219/046* (2013.01); *C10N 2210/01* (2013.01); *C10N 2230/02* (2013.01); *C10N 2230/04* (2013.01); *C10N 2230/06* (2013.01); *C10N 2230/08* (2013.01); *C10N 2230/12* (2013.01); *C10N 2230/52* (2013.01); *C10N 2240/102* (2013.01); *C10N 2240/105* (2013.01); *C10N 2270/02* (2013.01)

(56) References Cited

U.S. PATENT DOCUMENTS

| | | | | |
|---|---|---|---|---|
| 2011/0077177 | A1* | 3/2011 | Doyen ..... | C10M 129/70<br>508/175 |
| 2011/0092403 | A1 | 4/2011 | Lancon et al. | |
| 2012/0077721 | A1 | 3/2012 | Dolmazon et al. | |
| 2012/0129742 | A1 | 5/2012 | Matray et al. | |
| 2013/0244917 | A1 | 9/2013 | Obrecht et al. | |

* cited by examiner

CYLINDER LUBRICANT FOR A TWO-STROKE MARINE ENGINE

CROSS-REFERENCE TO RELATED APPLICATIONS

This application is a National Phase Entry of International Application No. PCT/EP2012/056812, filed on Apr. 13, 2012, which claims priority to French Patent Application Serial No. 1153276, filed on Apr. 14, 2011, both of which are incorporated by reference herein.

FIELD

The present invention relates to a cylinder lubricant for a two-stroke marine engine that can be used both with high-sulphur fuel oils and low-sulphur fuel oils. It relates more particularly to a lubricant having a sufficient neutralization power vis-à-vis sulphuric acid formed during the combustion of high-sulphur fuel oils, whilst limiting the formation of deposits during the use of low-sulphur fuel oils.

BACKGROUND

The marine oils used in low-speed two-stroke crosshead engines, are of two types. On the one hand, cylinder oils, ensuring the lubrication of the cylinder-piston assembly, and, on the other hand, system oils ensuring the lubrication of all the moving parts apart from the cylinder-piston assembly. Within the cylinder-piston assembly, the combustion residues containing acid gases are in contact with the lubricating oil.

The acid gases are formed from the combustion of the fuel oils; they are in particular sulphur oxides ($SO_2$, $SO_3$), which are then hydrolyzed on contact with the moisture present in the combustion gases and/or in the oil. This hydrolysis generates sulphurous ($HSO_3$) or sulphuric ($H_2SO_4$) acid. To protect the surface of piston liners and avoid excessive corrosive wear, these acids must be neutralized, which is generally done by reaction with the basic sites included in the lubricant.

An oil's neutralization capacity is measured by its BN or Base Number, characterized by its basicity. It is measured according to standard ASTM D-2896 and is expressed as an equivalent in milligrams of potash per gram of oil (also called "mg of KOH/g" or "BN point"). The BN is a standard criterion making it possible to adjust the basicity of the cylinder oils to the sulphur content of the fuel oil used, in order to be able to neutralize all of the sulphur contained in the fuel, and capable of being converted to sulphuric acid by combustion and hydrolysis.

Thus, the higher the sulphur content of a fuel oil, the higher the BN of a marine oil needs to be. This is why marine oils with a BN varying from 5 to 100 mg KOH/g are found are found on the market. This basicity is provided by detergents that are overbased by insoluble metallic salts, in particular metallic carbonates. The detergents, mainly of anionic type, are for example metallic soaps of salicylate, phenate, sulphonate, carboxylate type etc. which form micelles where the particles of insoluble metallic salts are maintained in suspension. The usual overbased detergents intrinsically have a BN in a standard fashion comprised between 150 and 700 mg KOH per gram of detergent. Their percentage by mass in the lubricant is fixed as a function of the desired BN level.

Part of the BN can also be provided by non-overbased or "neutral" detergents with a BN typically less than 150.

However, the production of marine engine cylinder lubricant formulas where the entire BN is provided by "neutral" detergents cannot be envisaged: it would in fact be necessary to incorporate them in excessive quantities, which could be detrimental to other properties of the lubricant and would not be realistic from an economic point of view. The insoluble metallic salts of the overbased detergents, for example calcium carbonate, therefore contribute significantly to the BN of the usual lubricants. It can be considered that approximately at least 50%, typically 75%, of the BN of the cylinder lubricants is thus provided by these insoluble salts. The actual detergent part, or metallic soaps, found in both the neutral and overbased detergents, typically provides most of the remainder of the BN.

Environmental concerns have led, in certain areas and in particular coastal areas, to requirements relating to the limitation of the level of sulphur in the fuel oils used on ships. Thus, the regulation MARPOL Annex 6 (Regulations for the Prevention of Air Pollution from Ships) issued by the IMO (International Maritime Organization) entered into force in May 2005. It sets a global cap of 4.5% m/m on the sulphur content of heavy fuel oils as well as creating sulphur oxide emission control areas, called SECAs (Sulphur Emission Control Areas). Ships entering these areas must use fuel oils with a maximum sulphur content of 1.5% m/m or any other alternative treatment intended to limit the SOx emissions in order to comply with the specified values. The notation m/m denotes the percentage by mass of a compound relative to the total weight of fuel oil or lubricating composition in which it is included.

More recently the MEPC (Marine Environment Protection Committee) met in April 2008 and approved proposed amendments to the regulation MARPOL Annex 6. These proposals are summarized in the table below. They present a scenario in which the restrictions on the maximum sulphur content become more severe with a worldwide maximum content reduced from 4.5% m/m to 3.5% m/m as from 2012. The SECAs (Sulphur Emission Control Areas) will become ECAs (Emission Control Areas) with an additional reduction in the maximum permissible sulphur content from 1.5% m/m to 1.0% m/m as from 2010 and the addition of new limits relating to contents of NOx and particles.

| | Current Regulation MARPOL Annex 6 | |
|---|---|---|
| | General limit | Limit for the SECAs |
| Maximum sulphur content | 4.50% m/m | 1.50% m/m |

| | Amendments to MARPOL Annex 6 (MEPC Meeting No. 57 - April 2008) | |
|---|---|---|
| | General limit | Limit for the ECAs |
| Maximum sulphur content | 3.5% m/m on Jan. 01, 2012<br>0.5% m/m on Jan. 01, 2020 | 1% m/m on Jan. 03, 2010<br>0.1% m/m on Jan. 01, 2015 |

Ships sailing trans-continental routes already use several types of heavy fuel oil depending on local environmental constraints, allowing them to optimize their operating costs. This situation will continue irrespective of the final level of the maximum permissible sulphur content of fuel oils. Thus the majority of container ships currently under construction provide for the utilization of several bunker tanks, for a "high sea" fuel oil with a high sulphur content on the one hand and for a 'SECA' fuel oil with a sulphur content less than or equal to 1.5% m/m on the other hand. Switching between these two categories of fuel oil can require adaptation of the engine's operating conditions, in particular the utilization of appropriate cylinder lubricants.

Currently, in the presence of fuel oil with a high sulphur content (3.5% m/m and more), marine lubricants having a BN of the order of 70 are used. In the presence of a fuel oil with a low sulphur content (1.5% m/m and less), marine lubricants having a BN of the order of 40 are used (in the future this value will be reduced). In these two cases, a sufficient neutralizing capacity is achieved as the necessary concentration in basic sites provided by the overbased detergents of the marine lubricant is reached, but it is necessary to change lubricant at each change of type of fuel oil.

Moreover, each of these lubricants has limits of use resulting from the following observations: the use of a cylinder lubricant of BN 70 in the presence of a fuel oil with a low sulphur content (1.5% m/m and less) and at a fixed lubrication level, creates a significant excess of basic sites (high BN) and a risk of destabilization of the micelles of unused overbased detergent, which contain insoluble metallic salts. This destabilization results in the formation of deposits of insoluble metallic salts (for example calcium carbonate), mainly on the piston crown, and can eventually lead to a risk of excessive wear of the liner-polishing type. Therefore, the optimization of the cylinder lubrication of a low-speed two-stroke engine then requires the selection of the lubricant with the BN adapted to the fuel oil and to the operating conditions of the engine. This optimization reduces the flexibility of operation of the engine and requires a significant degree of technical expertise on the part of the crew in defining the conditions under which the switching from one type of lubricant to the other must be carried out.

In order to simplify the operations, it would therefore be desirable to have a single cylinder lubricant for two-stroke marine engines which can be used with both high-sulphur fuel oils and low-sulphur fuel oils. In particular, a need exists for formulations in which the BN is provided, alternatively to the overbased detergents, by compounds that do not give rise to metallic deposits when they are present in excess relative to the quantity of sulphuric acid to be neutralized.

The application WO 2009/153453 discloses cylinder lubricants for two-stroke marine engines which can be used with both high-sulphur fuel oils and low-sulphur fuel oils. The lubricant compositions have a BN greater than or equal to 15, and comprise one or more lubricant base oils for marine engines, at least one overbased detergent, optionally in combination with a neutral detergent, one or more oil-soluble fatty amines. The fatty amines provide the lubricant with at least 10 BN points, and the overbased detergents at the most 20 BN points.

These lubricant compositions can have a BN of the order of 50 and are as effective from the point of view of the kinetics of neutralization of the acids as cylinder lubricants with a much higher BN (typically 70), specifically designed for high-sulphur fuels; their reduced level of overbased detergents also allows them to be adapted to low sulphur contents. However, in this type of composition, a significant part of the BN (at least 10 mg of KOH/g), is provided by the fatty amines. This high level of amine can, for certain of them, pose problems of toxicity. It results moreover in a degradation of thermal behaviour (measured in particular by their ability to form deposits in the ECBT test or "Elf Coking Bench Test" described below).

The anti-wear performances of these oils can moreover be improved. Finally, maintaining the performances of these oils throughout their residence time (approximately 30 minutes) in the cylinder poses problems.

The application FR 2094182 discloses a lubricant composition comprising from 0.01 to 5% of an acid neutralization accelerator which can be an ethoxylated fatty diamine, and sufficient alkaline-earth metal carbonate to confer a BN of 0.5 to 100 mg KOH/g on the composition. These carbonates can be dispersed in the lubricant by phenates or sulphonates.

In these compositions, virtually all of the BN is provided by alkaline-earth metal carbonates. No mention is made of the parts of the BN provided respectively by the amines, detergents, metallic carbonates. No mention is made of the presence of neutral detergents in these compositions. These compositions exhibit mediocre thermal behaviour (measured in particular by their ability to form deposits in the ECBT test).

A need therefore exists for cylinder lubricants for a two-stroke marine engine which can be used with both high-sulphur fuels and low-sulphur fuels, and the thermal behaviour and anti-wear effect of which is improved compared with the lubricants of the prior art. The present invention relates to a lubricant composition which can be used as cylinder lubricant for two-stroke marine engines, which can be used with both high- and low-sulphur fuels, and which makes it possible to remedy the abovementioned drawbacks. The lubricant compositions according to the invention comprise alkoxylated fatty amines in limited quantities, combined with neutral detergents and overbased detergents in specific proportions. They are as effective from the point of view of acid neutralization kinetics as cylinder lubricants with a much higher BN (typically 70), specifically designed for high-sulphur fuels; their reduced level of overbased detergents also allows them to be adapted to low-sulphur fuels.

The compositions according to the invention exhibit very good anti-wear properties, and better thermal behaviour than the compositions of the prior art. They resist ageing better and retain these properties throughout their residence time in the cylinder of the marine engine.

SUMMARY

The present invention relates to a cylinder lubricant for a two-stroke marine engine having a BN determined according to the standard ASTM D-2896 greater than or equal to 15 milligrams of potash per gram of lubricant, comprising:

(a) one or more lubricant base oils for marine engines,
(b) at least one detergent based on alkali or alkaline-earth metals, overbased with metallic carbonate salts,
(c) at least one neutral detergent,
(d) one or more oil-soluble alkoxylated fatty amines having a BN determined according to the standard ASTM D-2896 comprised between 100 and 600 milligrams of potash per gram, where the percentage by mass of alkoxylated fatty amines with respect to the total weight of lubricant is chosen such that the BN provided by these compounds represents a contribution comprised between 2 and 8 milligrams of potash per gram of lubricant, and where the BN provided by the metallic carbonate salts represents a contribution of at the most 65% of the total BN, measured according to the standard ASTM D2896, of said cylinder lubricant.

Preferably, in the cylinder lubricants according to the invention, the BN of the alkoxylated fatty amines determined according to the standard ASTM D-2896 is comprised between 120 and 500, preferably between 150 and 400, preferably between 200 and 300 milligrams of potash per gram. Preferably, in the cylinder lubricants according to the invention, the percentage by mass of alkoxylated fatty amines with respect to the total weight of lubricant is chosen such that the BN provided by these compounds represents a contribution comprised between 3 and 7 milligrams of potash per gram of lubricant, preferably between 3.5 and 5 milligrams of potash per gram of lubricant of the total BN of said cylinder lubricant, determined according to the standard ASTM D-2896.

According to an embodiment, the cylinder lubricants according to the invention have a BN, determined according to the standard ASTM D-2896, greater than or equal to 20, preferably greater than 30, advantageously greater than 40 milligrams of potash per gram of lubricant. Preferably, the cylinder lubricants according to the invention have a BN, determined according to the standard ASTM D-2896, less than 55 milligrams of potash per gram of lubricant. According to an embodiment, the cylinder lubricants according to the invention have a BN, determined according to the standard ASTM D-2896, comprised between 40 and 50 milligrams of potash per gram of lubricant, preferably between 42 and 45 milligrams of potash per gram of lubricant.

According to another embodiment, the cylinder lubricants according to the invention have a BN, determined according to the standard ASTM D-2896, comprised between 50 and 55 milligrams of potash per gram of lubricant, preferably between 51 and 53 milligrams of potash per gram of lubricant. Preferably, in the cylinder lubricants according to the invention, the BN provided by the metallic carbonate salts represents a contribution comprised between 10% and 60%, preferably between 20% and 55%, preferably between 30% and 50%, of the total BN of said cylinder lubricant. According to a preferred embodiment, in the cylinder lubricants according to the invention, the oil-soluble alkoxylated fatty amine or amines are obtained from palm, olive, peanut, standard or oleic rapeseed, standard or oleic sunflower, soya or cotton oil, from beef tallow, or from palmitic, stearic, oleic or linoleic acid. Preferably, in the cylinder lubricants according to the invention, the oil-soluble alkoxylated fatty amine(s) are obtained from fatty acids comprising between 16 and 18 carbon atoms.

Particularly preferably, in the cylinder lubricants according to the invention, the alkoxylated fatty amine(s) correspond to general formula (I):

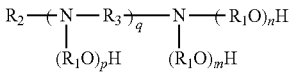

(I)

where $R_1$ is an ethylene, propylene, butylene radical, preferably ethylene, $R_2$ is a fatty chain of saturated or unsaturated fatty acids, comprising between 12 and 22 carbon atoms, preferably between 16 and 18 carbon atoms, preferably the fatty chain of the oleic acid, $R_3$ is an alkylene radical comprising between 2 and 3 carbon atoms, q is equal to 0 or to 1, and when q is equal to zero, p is equal to zero n, m and p are integers comprised between 0 and 12, preferably between 0 and 5, preferably between 0 and 2, and n+m+p is strictly greater than zero, preferably comprised between 1 and 15, preferably between 2 and 10, preferably between 3 and 7, preferably between 3 and 4.

Yet more preferably, in the cylinder lubricants according to the invention, the alkoxylated fatty amine(s) correspond(s) to general formula (I) where:

q=p=0, m+n is comprised between 2 and 5, preferably between 3 and 4, m and n are non-zero.

According to an embodiment, in the cylinder lubricants according to the invention, the overbased detergents (b) and the neutral detergents (c) are chosen from the carboxylates, sulphonates, salicylates, naphthenates, phenates, and mixed detergents combining at least two of these types of detergents. According to a preferred embodiment, in the cylinder lubricants according to the invention, at least one overbased detergent (b) is a sulphonate. According to a particularly preferred embodiment, in the cylinder lubricants according to the invention, at least one neutral detergent (c) is a phenate or a sulphonate, preferably a phenate.

According to an embodiment, the cylinder lubricants according to the invention also comprise from 0.1 to 10% by mass, preferably from 0.2 to 2%, preferably from 0.3 to 1.5%, preferably from 0.4 to 1%, preferably from 0.5 to 1% of one or more compounds chosen from:

the primary, secondary or tertiary fatty monoalcohols, the alkyl chain of which is saturated or unsaturated, linear or branched, and comprise at least 12 carbon atoms, preferably between 12 and 24 carbon atoms, preferably between 16 and 18 carbon atoms, preferably the primary monoalcohols with a saturated linear alkyl chain, the esters of saturated fatty monoacids comprising at least 14 carbon atoms and alcohols comprising at the most 6 carbon atoms, preferably the mono- and diesters, preferably the monoesters of monoalcohol, and the diesters the ester functions of which are at most four atoms away counted from the oxygen side of the ester function.

According to a preferred embodiment, the cylinder lubricants according to the invention have a kinematic viscosity measured according to the standard ASTM D445 at 100° C. comprised between 12.5 and 26.1 cSt, preferably comprised between 16.3 and 21.9 cSt. The present invention also relates to the use of a lubricant as described above as a single cylinder lubricant which can be used both with fuel oils with a sulphur content less than 1.5% m/m and with fuel oils with a sulphur content greater than 3.5% m/m in two-stroke marine engines. The present invention also relates to the use of a lubricant as described above as a single cylinder lubricant which can be used both with fuel oils with a sulphur content less than 1% m/m and with fuel oils with a sulphur content greater than 3% m/m in two-stroke marine engines.

The present invention also relates to the use of a lubricant as described above as cylinder lubricant which can be used with all fuel oils with a sulphur content comprised between 0.1% m/m and 3.5% m/m in two-stroke marine engines. The present invention also relates to the use of a lubricant as described above to prevent corrosion and/or reduce the formation of insoluble metallic salt deposits in the cylinders of two-stroke marine engines during the combustion of any type of fuel oil the sulphur content of which is less than 4.5% m/m.

The present invention also relates to a concentrate of additives for the preparation of cylinder lubricants having a BN determined according to the standard ASTM D-2896 greater than or equal to 15, preferably greater than 20, preferably greater than 30, advantageously greater than 40 milligrams of potash per gram of lubricant, said concentrate having a BN comprised between 180 and 250, and comprising one or more alkoxylated fatty amines with a BN comprised between 100 and 600 mg of potash/g of amine according to the standard ASTM D-2896, the percentage by mass of said alkoxylated fatty amines in the concentrate being chosen so as to provide said concentrate with a BN contribution determined according to the standard ASTM D-2896 comprised between 10 and 40, preferably between 12 and 30, preferably between 15 and 25, typically of the order of 20 milligrams of potash per gram of concentrate.

DETAILED DESCRIPTION

Figure 1:
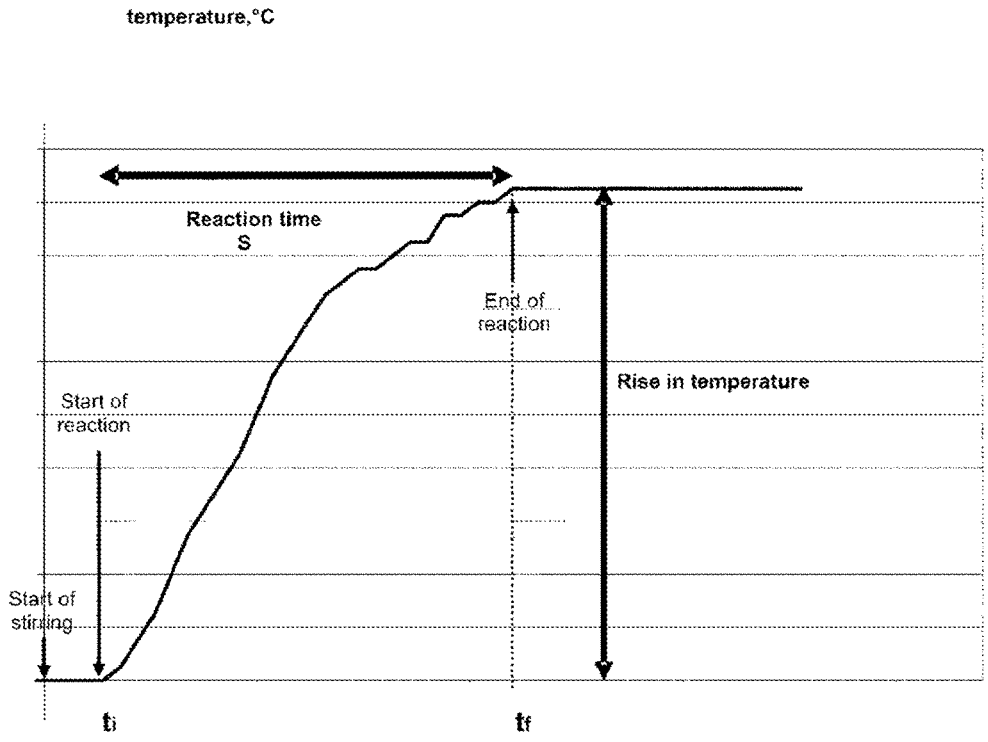
FIG. 1 is a graph showing neutralization reaction times.

The Alkoxylated Fatty Amines and Other Accelerators of the Rate of Neutralization:

The fatty amines used in the lubricants according to the present invention are alkoxylated fatty amines, preferably monoamines, or diamines comprising one or more aliphatic chains. These compounds have an intrinsic basicity and contribute to the BN of the lubricants according to the invention. The intrinsic BN of the alkoxylated fatty amines used in the present invention, measured according to the standard ASTM D-2896, is typically comprised between 100 and 600 milligrams of potash per gram, preferably comprised between 120 and 500 milligrams of potash per gram, preferably comprised between 150 and 400 milligrams of potash per gram, preferably comprised between 200 and 300 milligrams of potash per gram.

These are (weak) cationic-type surfactants the polar head of which is made up of the nitrogen atom and one or more oxygen atoms provided by the alkoxylation, and the lipophilic part is made up of the fatty aliphatic chain(s). Thus, it is preferable, in order to obtain a surfactant character, that this polar head is constituted by amine functions not far from each other (typically separated by 2 to 3 carbon atoms), and preferably in a restricted number (typically one or two amine functions), and preferably alkoxylated with a limited number of alkylene oxide functions, typically between 1 and 15, preferably between 2 and 10, preferably between 3 and 7, preferably between 3 and 4, and preferably with alkylene oxides comprising from 2 to 4 carbon atoms. This makes it possible to constitute a "compact" polar head, and therefore a surfactant character for these alkoxylated fatty amines.

Due to their (weak) surfactant character and their (strong) lipophilic character, these compounds can both be stabilized in solution in the oil matrix and shift the chemical equilibria within the overbased detergents present in the lubricants according to the invention. Therefore, the basic sites (insoluble metallic salts) provided by the overbased detergents are more accessible, which makes the sulphuric acid neutralization reaction by said basic sites more effective.

The alkoxylated fatty amines are obtained by known alkoxylation processes, for example described in the application FR 2 094 182, by contacting fatty amines and alkylene oxides, at temperatures for example comprised between 100 and 200° C., into the presence of a basic catalyst which can be NaOH, KOH, $NaOCH_3$. The starting fatty amines are mainly obtained from carboxylic acids. These acids are dehydrated in the presence of ammonia in order to produce nitriles, which are then subjected to catalytic hydrogenation in order to produce primary, secondary or tertiary amines.

The starting fatty acids for obtaining fatty amines are for example the caprylic, pelargonic, capric, undecylenic, lauric, tridecylenic, myristic, pentadecylic, palmitic, margaric, stearic, nonadecylic, arachic, heneicosanoic, behenic, tricosanoic, lignoceric, pentacosanoic, cerotic, heptacosanoic, montanic, nonacosanoic, melissic, hentriacontanoic, laceroic acids or unsaturated fatty acids such as palmitoleic, oleic, erucic, nervonic, linoleic, a-linolenic, c-linolenic, dihomo-c-linolenic, arachidonic, eicosapentaenoic, docosahexanoic acid. The preferred fatty acids result from the hydrolysis of the triglycerides present in vegetable and animal oils, such as copra, palm, olive, peanut, rapeseed, sunflower, soya, cotton or linseed oil, beef tallow, etc.; natural oils may have been genetically modified so as to enrich their content of certain fatty acids, for example oleic rapeseed or sunflower oil. The fatty amines used for preparing the alkoxylated fatty amines of the lubricants according to the invention are preferably obtained from vegetable or animal natural resources. The treatments making it possible to produce fatty amines from natural oils can lead to mixtures of primary, secondary and tertiary monoamines and polyamines.

It is possible for example to use, for preparing the alkoxylated amines of the lubricants according to the present invention products containing, in variable proportions, all or part of the fatty amines corresponding to the following formulae:

$$R_1NH_2,$$

$$R_1—NH—R$$

$$R_1—NHCH_2—R$$

$$R_1—[NH(CH_2)_3]_2—NH_2$$

$$R_1—[NH(CH_2)_r]_q—NH_2$$

where q is an integer greater than 1, preferably comprised between 1 and 12, or between 1 and 5, or between 1 and 2, r is an integer comprised between 2 and 3, and R and $R_1$ are fatty chains obtained from the fatty acids present in the starting oil. The same fatty mono- or polyamine can contain several fatty chains obtained from different fatty acids.

It is also possible to use these products in purified form, mostly containing a single type of amines, for example mostly monoamines or mostly diamines.

A product constituted by primary monoamines of formula $R_1NH_2$ will thus advantageously be used, where $R_1$ can represent a plurality of fatty acids obtained from a natural resource, for example tallow fat, or soya oil, or coconut oil, or sunflower oil (oleic). A product constituted by diamines of formula $R_1—[NH(CH_2)_3]—NH_2$, will also advantageously be used, where $R_1$ can represent a plurality of fatty acids obtained from a natural resource, for example tallow fat, or soya oil, or coconut oil, or sunflower oil (oleic). It is also possible to use purified products. For example, amines obtained from oleic acid are advantageously used, in particular primary monoamines of formula $R_1NH_2$ or diamines of formula $R_1$—[$NH(CH_2)_3$]—$NH_2$ where $R_1$ is the fatty chain of oleic acid.

The alkoxylated amines of the lubricants according to the present invention must be highly soluble in the oil matrix in order to be able to effectively enhance the acid neutralization kinetics. In fact, in this regard they act in two ways: either by directly neutralizing the droplets of acids dispersed in the oil matrix, or by destabilizing the micelles of the overbased detergents in order to increase the effectiveness of the basic sites of said overbased detergents.

The solubility of the alkoxylated fatty amines is firstly due to their fatty chain. These amines are also more soluble, the more limited the number of alkylene oxide functions that they comprise. The Applicant has also found that the alkoxylated amines where the nitrogen atoms are ternary (where there is no longer any N—H bond) are easier to solubilize, preferably the monoamines with ternary nitrogen.

Thus, it is preferable to use, in the compositions according to the invention, alkoxylated amines of formula (I) below:

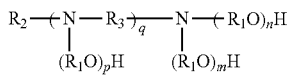

where $R_1$, $R_2$, $R_3$ are as defined above, n, m, and p are non-zero integers such that n+m+p is comprised between 1 and 15, According to a preferred embodiment, q=p=0 and m and n are non-zero integers such that m+n is comprised between 1 and 5, preferably between 2 and 4.

These alkoxylated amines are therefore the more effective the better dispersed—solubilized in the oil matrix they are. Thus, the fatty amines of the lubricants according to the present invention are not in emulsion or microemulsion form, but well dispersed in the oil matrix. The fatty amines according to the present invention are therefore preferably those which comprise at least one aliphatic chain constituted by at least 12 carbon atoms, preferably at least 14 carbon atoms, preferably at least 16 carbon atoms, preferably at least 18 carbon atoms.

Surprisingly, the Applicant has found that these alkoxylated amines, and mainly the ethoxylated fatty monoamines (preferably of formula (I) above where p=q=0 and m and n are non-zero integers, preferably such that m+n is comprised between 1 and 5, preferably between 2 and 4) would confer remarkable anti-wear properties on the cylinder lubricants which contain them. However, when they are present in too large a quantity, the thermal behaviour properties of the lubricants which contain them are degraded.

Other molecules possessing a (weak) surfactant character and a (strong) lipophilic character can advantageously be used in combination with the alkoxylated fatty amines described above. These compounds increase the rate of neutralization of the acids by the lubricant. They can both be stabilized in solution in the oil matrix and shift the chemical equilibria within the overbased detergents present in the lubricants according to the invention. Therefore, the basic sites (insoluble metallic salts) provided by the overbased detergents are more accessible, which makes the sulphuric acid neutralization reaction by said basic sites more effective.

These compounds can be used in combination with the alkoxylated amines with contents comprised between 0.1 and 10% by mass, preferably between 0.1 and 2%, preferably between 0.3 and 1.5%, preferably between 0.4 and 1%, preferably between 0.5 and 1%. These are in particular primary, secondary or tertiary fatty monoalcohols, the alkyl chain of which is saturated or unsaturated, linear or branched, and comprises at least 12 carbon atoms, preferably between 12 and 24 carbon atoms, preferably from 16 to 18 carbon atoms. Preferably, these fatty monoalcohols are primary monoalcohols with a saturated linear alkyl chain, preferably comprising from 16 to 18 carbon atoms. They can also be saturated fatty monoacid esters comprising at least 14 carbon atoms and alcohols comprising at the most 6 carbon atoms, preferably chosen from the mono- and diesters, preferably from the monoalcohol monoesters, and the diesters the ester functions of which are at most four carbon atoms away counted from the oxygen side of the ester function.

BN of the Lubricants

The BN of the lubricants according to the present invention is provided by the neutral or overbased detergents based on alkali or alkaline-earth metals and by one or more alkoxylated fatty amines. The value of this BN, measured according to the standard ASTM D-2896 can vary in the case of a lubricant from 0.5 to 100 mg KOH/g, or beyond. The BN of a cylinder lubricant for marine engines is chosen as a function of the conditions of use of said lubricants and in particular according to the sulphur content of the fuel oil used in combination with said lubricants cylinder.

The lubricants according to the present invention are suited to use as cylinder lubricant, irrespective of the sulphur content of the fuel oil used as fuel in the engine. Therefore, the cylinder lubricants for a two-stroke marine engine according to the invention have a BN greater than or equal to 15 milligrams of potash per gram of lubricant, preferably greater than 20, preferably greater than 30, advantageously greater than 40.

According to a preferred embodiment, the cylinder lubricants according to the invention have a BN less than 55, typically comprised between 40 and 55, preferably between 40 and 50, preferably between 42 and 45 typically of the order of 43 or 44 milligrams of potash per gram of lubricant. This corresponds to the BN of the cylinder lubricant formulae of the prior art used specifically and solely with low-sulphur fuel oils where (virtually) all of the BN is provided by overbased detergents. According to another preferred embodiment, the lubricants according to the invention have a BN comprised between 50 and 55, typically comprised between 51 and 53 milligram of potash per gram of lubricant. This corresponds to an intermediate BN between the formulae of the prior art for which (virtually) all of the BN is provided by overbased detergents, specifically used with low-sulphur fuel oils, and those specifically used with high-sulphur fuel oils.

The share of BN provided by the alkoxylated fatty amines in the lubricants according to the invention is comprised between 2 and 8, preferably between 3 and 7, preferably between 3.5 and 5 milligrams of potash per gram of lubricant (or "BN points"). The share of BN provided by a fatty amine in the lubricant (in milligrams of potash per gram of finished lubricant, or also BN "points") is calculated from its intrinsic BN measured according to the standard ASTM D-2896 and its percentage by mass in the finished lubricant:

$$BN_{lub\ amine}=x\cdot BN\ amine/100$$

$BN_{lub\ amine}$=contribution of the amine to the BN of the finished lubricant x=% by mass of the amine in the finished lubricant $BN_{amine}$=intrinsic BN of the amine alone (ASTM D-2896).

The intrinsic BN of the alkoxylated amines of the lubricants according to the invention is comprised between 100 and 600, preferably between 120 and 500, preferably between 150 and 400, preferably between 200 and 300. Thus, in the lubricants according to the invention, the alkoxylated fatty amines provide between 0.33% (addition of 2 BN points by an amine of BN 600) and 8% (addition of 8 BN points by an amine of BN 100) of the total BN, preferably between 0.4% (addition of 2 BN points by an amine of BN 500) and 6.7% (addition of 8 BN points by an amine of BN 120) of the total BN, preferably between 0.5% (addition of 2 BN points by an amine of BN 400) and 5.3% (addition of 8 BN points by an amine of BN 150) of the total BN, preferably between 0.7% (addition of 2 BN points by an amine of BN 300) and 4% (addition of 8 BN points by an amine of BN 200) of the total BN.

Below a certain content of alkoxylated fatty amines, no improvement is obtained in the acid neutralization kinetics. Moreover, the incorporation of a high content of fatty amines led to a significant reduction in viscosity, such that beyond a maximum percentage of fatty amines, it is no longer possible to formulate lubricants having the viscosity grade required for use as cylinder lubricant, unless extremely large quantities of thickening additives are incorporated, which would lead to unrealistic formulae from an economic point of view and would be detrimental to other properties of the lubricant. The incorporation of a high content of amines may also give rise to toxicity problems. Moreover, the Applicant has found that the incorporation of a high content of alkoxylated amines leads to a degradation in the thermal behaviour.

Detergents, Overbased or not

The detergents used in the lubricant compositions according to the present invention are well known to a person skilled in the art. The detergents commonly used in the formulation of lubricating compositions are typically anionic compounds comprising a long lipophilic hydrocarbon chain and a hydrophilic head. The associated cation is typically a metallic cation ion of an alkali or alkaline-earth metal.

The detergents are preferably chosen from the alkali or alkaline-earth metal salts of carboxylic acids, sulphonates, salicylates, naphthenates, as well as the salts of phenates. The alkali and alkaline-earth metals are preferably calcium, magnesium, sodium or barium.

These metallic salts can contain the metal in an approximately stoichiometric quantity. In this case, the detergents are described as non-overbased or "neutral", although they still provide a certain basicity. These "neutral" detergents typically have a BN, measured according to ASTM D2896, less than 150 mg KOH/g, or less than 100, or even less than 80 mg KOH/g.

This type of so-called neutral detergents can partly contribute to the BN of the lubricants according to the present invention. For example neutral detergents such as carboxylates, sulphonates, salicylates, phenates, naphthenates of alkali and alkaline-earth metals, for example calcium, sodium, magnesium, or barium will be used.

When the metal is in excess (in a quantity greater than the stoichiometric quantity), we are dealing with so-called overbased detergents. Their BN is high, greater than 150 mg KOH/g, typically comprised between 200 and 700 mg KOH/g, generally comprised between 250 and 450 mg KOH/g. The metal in excess providing the overbased character of the detergent is presented in the form of metallic salts that are insoluble in oil, for example carbonate, hydroxide, oxalate, acetate, glutamate, preferably carbonate.

In the same overbased detergent, the metals of these insoluble salts can be the same as or different from those of the oil-soluble detergents. They are preferably chosen from calcium, magnesium, sodium or barium. The overbased detergents are thus presented in the form of micelles composed of insoluble metallic salts maintained in suspension in the lubricating composition by the detergents in the form of oil-soluble metallic salts. These micelles can contain one or more types of insoluble metallic salts, stabilized by one or more detergent types.

The overbased detergents comprising a single type of soluble detergent metallic salt are generally named according to the nature of the hydrophobic chain of the latter detergent. Thus, they are said to be of phenate, salicylate, sulphonate or naphthenate type according to whether this detergent is a phenate, salicylate, sulphonate, or naphthenate respectively. The overbased detergents are said to be of mixed type if the micelles comprise several types of detergents, differing from each other by the nature of their hydrophobic chain.

For use in the lubricating compositions according to the present invention, the oil-soluble metallic salts are preferably phenates, sulphonates, salicylates, and mixed phenate—sulphonate and/or salicylate detergents, preferably calcium, magnesium, sodium or barium, phenates and/or sulphonates, preferably calcium phenates and/or sulphonates. The insoluble metal salts providing the overbased character are alkali and alkaline-earth metal carbonates, preferably calcium carbonate. The overbased detergents used in the lubricating compositions according to the present invention are preferably phenates, sulphonates, salicylates and mixed phenate-sulphonate-salicylate detergents, overbased with calcium carbonate, preferably sulphonates and phenates overbased with calcium carbonate.

BN Provided by the Detergents in the Lubricants:

In the lubricants according to the present invention, part of the BN is provided by the insoluble metallic salts of the overbased detergents, in particular the metallic carbonates. The BN provided by the metallic carbonate salts (or carbonate BN or $BN_{CaCO3}$) is measured on the overbased detergent alone and/or on the final lubricant according to the method described in Example 1. Typically in an overbased detergent, the BN provided by the metallic carbonate salts represents from 50 to 95% of the total BN of the overbased detergent alone. It should be noted that certain neutral detergents also comprise a certain insoluble metallic salt (calcium carbonate) content (much smaller than the overbased detergents), and can themselves contribute to the carbonate BN.

In the lubricants according to the invention, the percentage by mass of overbased (and neutral) detergents with respect to the total weight of lubricant is chosen such that the BN provided by the metallic carbonate salts represents a contribution of at the most 65%, preferably at the most 60% of the total BN (according to ASTM D-2896) of said cylinder lubricant. In fact, when the contribution of the BN carbonate to the total BN of the cylinder lubricant becomes too great, a pronounced degradation of the thermal behaviour of the lubricant is noted. These insoluble metallic salts moreover have a favourable anti-wear effect if they are maintained dispersed in the lubricant in the form of stable micelles (which is not the case when they are found in excess in relation to the quantity of sulphuric acid to be neutralized during operation).

Thus, in the lubricants according to the invention, the carbonate BN provided by the insoluble metallic salts (calcium carbonate) represent preferably between 10% and 60%, preferably between 20% and 55%, preferably between 30% and 50% of the total BN (ASTM D-2896) of said lubricant. Thus, for lubricants according to the invention typically having a BN (ASTM D-2896) of the order of 40 to 50, typically of the order of 45 milligrams of potash per gram of lubricant, the BN contribution provided by the insoluble metallic salts of overbased detergents is of the order of 20 to 25 milligrams of potash per gram of lubricant, typically from 22 to 24 milligrams of potash per gram of lubricant or "BN point". Moreover, the actual detergents, which are metallic soaps of the essentially phenate or sulphonate, or salicylate, type, also contribute to the BN of the lubricants according to the present invention.

The BN of the lubricants according to the present invention, measured according to ASTM D2896 therefore comprises several distinct components, including at least:

1) The BN provided by the insoluble metallic salts of the overbased detergents, called by extension "carbonate BN" or "$BN_{CaCO3}$", and measured using the method described in Example 1 hereafter,
2) The remainder of the BN, hereafter designated "organic BN", which can be measured by the difference between the total ASTM D-2896 BN of the lubricant and its carbonate BN, and provided:
   - by the metallic soaps of the overbased and optionally neutral detergents,
   - by the alkoxylated fatty amines, (this amine BN being determined as a function of the BN of the amines measured according to ASTM D-2896 and the percentage by mass of fatty amines).

The Base Oils

In general, the base oils used for the formulation of lubricants according to the present invention can be oils of mineral, synthetic or vegetable origin as well as their mixtures. The mineral or synthetic oils generally used in the application belong to one of the classes defined in the API classification as summarized in the table below.

| | Content of saturates | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydro-isomerized oils | ≥90% | ≤0.03% | ≥120 |
| Group IV | PAO (Polyalphaolefins) | | |
| Group V | Other bases not included in base groups I to IV | | |

The mineral oils in Group I can be obtained by distillation of selected naphthenic or paraffinic crude oils then purification of these distillates by processes such as solvent extraction, solvent or catalytic dewaxing, hydrotreating or hydrogenation. The oils in Groups II and III are obtained by more severe purification processes, for example a combination of hydrotreating, hydrocracking, hydrogenation and catalytic dewaxing. Examples of synthetic bases in Groups IV and V include the polyalphaolefins (PAO), polybutenes, polyisobutenes and alkylbenzenes.

These base oils can be used alone or in a mixture. A mineral oil can be combined with a synthetic oil.

Cylinder oils for 2-stroke marine diesel engines have a viscosimetric grade of SAE-40 to SAE-60, generally SAE-50 equivalent to a kinematic viscosity at 100° C. comprised between 16.3 and 21.9 $mm^2/s$. Grade 40 oils have a kinematic viscosity at 100° C. comprised between 12.5 and 16.3 cSt. Grade 50 oils have a kinematic viscosity at 100° C. comprised between 16.3 and 21.9 cSt. Grade 60 oils have a kinematic viscosity at 100° C. comprised between 21.9 and 26.1 cSt.

According to industry practice, it is preferred to formulate cylinder oils for 2-stroke marine diesel engines having a kinematic viscosity at 100° C. comprised between 18 and 21.5, preferably between 19 and 21.5 $mm^2/s$ (cSt). This viscosity can be obtained by a mixture of additives and base oils for example containing mineral bases of Group I such as Neutral Solvent (for example 500 NS or 600 NS) and Bright Stock bases. Any other combination of mineral or synthetic bases or bases of vegetable origin having, in mixture with the additives, a viscosity compatible with the grade SAE 50 can be used.

Typically, a standard formulation of cylinder lubricant for low-speed 2-stroke marine diesel engines is of grade SAE 40 to SAE 60, preferably SAE 50 (according to the SAE J300 classification) and comprises at least 50% by weight of lubricating base oil of mineral and/or synthetic origin, suitable for use in marine engines, for example, of class API Group I, i.e. obtained by distillation of selected crude oils then purification of these distillates by processes such as solvent extraction, solvent or catalytic dewaxing, hydrotreating or hydrogenation. Their Viscosity Index (VI) is between 80 and 120; their sulphur content is greater than 0.03% and their content of saturates less than 90%.

Typically, a standard formulation of cylinder lubricant for low-speed 2-stroke marine diesel engines contains 18 to 25% by weight, relative to the total weight of lubricant, of a Group I base oil of a BSS type (distillation residue, with a kinematic viscosity at 100° C. of approximately 30 $mm^2/s$, typically comprised between 28 and 32 $mm^2/s$, and with a density at 15° C. comprised between 895 and 915 $kg/m^3$), and 50 to 60% by weight, relative to the total weight of lubricant, of a Group I base oil of a SN 600 type (distillate, with a density at 15° C. comprised between 880 and 900 $kg/m^3$, with a kinematic viscosity at 100° C. of approximately 12 $mm^2/s$).

Dispersant Additives

Dispersants are well-known additives used in the formulation of lubricating compositions, in particular for application in the marine field. Their primary role is to maintain in suspension the particles initially present or appearing in the lubricating composition during its use in the engine. They prevent their agglomeration by acting on the steric hindrance. They can also have a synergistic effect on neutralization.

The dispersants used as lubricant additives typically contain a polar group, associated with a relatively long hydrocarbon chain, generally containing 50 to 400 carbon atoms. The polar group typically contains at least one nitrogen, oxygen or phosphorus element.

Compounds derived from succinic acid are dispersants particularly used as lubrication additives. In particular succinimides, obtained by condensation of succinic anhydrides and amines, and succinic esters obtained by condensation of succinic anhydrides and alcohols or polyols are used. These compounds can then be treated with various compounds in particular sulphur, oxygen, formaldehyde, carboxylic acids and compounds containing boron or zinc in order to produce for example borated succinimides or zinc-blocked succinimides.

Mannich bases, obtained by polycondensation of phenols replaced by alkyl, formaldehyde and primary or secondary amine groups, are also compounds used as dispersants in lubricants. According to an embodiment of the present invention, at least 0.1% by mass of a dispersant additive, typically between 0.5 and 2%, typically between 1 and 1.5% by mass of dispersant are used. A dispersant from the family of PIB succinimides, for example borated or zinc-blocked, can be used.

Other Functional Additives

The lubricant formulation according to the present invention can also contain any functional additives appropriate to their use, for example anti-foam additives to counter the effect of the detergents, which can be for example polar polymers such as polymethylsiloxanes, polyacrylates, anti-oxidant and/or anti-rust additives, for example organo-metallic detergents or thiadiazoles. The latter are known to a person skilled in the art. These additives are generally present in a content by weight of 0.1 to 5%.

According to the present invention, the compositions of the lubricants described refer to the compounds taken separately before mixture, it being understood that said compounds may or may not retain the same chemical form before and after mixture. Preferably, the lubricants according to the present invention obtained by mixture of the compounds taken separately are not in the form of an emulsion or microemulsion.

Concentrates of Additives for Marine Lubricants:

The alkoxylated fatty amines contained in the lubricants according to the present invention can in particular be incorporated in a lubricant as distinct additives. However, they can also be incorporated in a concentrate of additives for a marine lubricant.

The standard concentrates of additives for marine cylinder lubricants are generally constituted by a mixture of the constituents described above, detergents, dispersants, other functional additives, pre-dilution base oil, in proportions making it possible to obtain, after dilution in a base oil of the cylinder lubricants having a BN determined according to the standard ASTM D-2896 greater than or equal to 15, preferably greater than 20, preferably greater than 30, advantageously greater than 40 milligrams of potash per gram of lubricant. This mixture generally contains, with respect to the total weight of concentrate, a detergent content greater than 70%, preferably greater than 80%, preferably greater than 90%, a dispersant additive content of 2 to 15%, preferably 5 to 10%, a content of other functional additives of 0 to 5% preferably of 0.1 to 1%. The BN of said concentrates, measured according to ASTM D 2896 is generally comprised between 250 and 300 milligrams of potash per gram of concentrate, typically of the order of 275 milligrams of potash per gram of concentrated.

According to a subject of the invention it relates to a concentrate of additives for the preparation of cylinder lubricant having a BN determined according to the standard ASTM D-2896 greater than or equal to 15, preferably greater than 20, preferably greater than 30, advantageously greater than 40 milligrams of potash per gram of lubricant, said concentrate having a BN comprised between 180 and 250, and comprising one or more alkoxylated fatty amines with a BN comprised between 100 and 600 mg of potash/g of amine according to the standard ASTM D-2896, the percentage by mass of said alkoxylated fatty amines in the concentrated being chosen so as to provide said concentrate with a contribution of BN determined according to the standard ASTM D-2896 comprised between 10 and 40, preferably between 12 and 30, preferably between 15 and 25, typically of the order of 20 milligrams of potash per gram of concentrate. The alkoxylated fatty amines of the concentrates according to the invention are those described above and in the following examples.

The concentrates according to the invention can also contain a small quantity of base oil (typically between 0 and 5% by mass), but sufficient to facilitate the utilization of said concentrates of additives. The concentrates according to the invention are diluted 4 to 5 times in a base oil or in a mixture of base oils in order to obtain the cylinder lubricants according to the invention. The present invention also relates to a process for the preparation of the cylinder lubricants according to the invention comprising the stage of mixing such a concentrate in one or more base oils, preferably of group I, such that said concentrate represents between 20 and 30% by mass, typically of the order of 25% by mass, in the cylinder lubricant.

Measurement of the Performance Differential Between a Conventional Reference Lubricant and a Lubricant This measurement is characterized by a neutralization efficiency index measured according to the enthalpy test method described in detail in the examples, in which the progress of the exothermic neutralization reaction is monitored by the rise in temperature observed when said lubricant containing the basic sites is brought into the presence of sulphuric acid. Of course the present invention is not limited to the examples and embodiment described and shown, but is capable of numerous variants accessible to a person skilled in the art.

EXAMPLES

Example 1

This example aims to describe the method making it possible to measure the contribution of the insoluble metallic salts present in the overbased detergents to the BN of the lubricating compositions containing said overbased detergents:

The total basicity measurement (referred to as BN or Base Number) of the finished lubricating oils or overbased detergents is carried out using the ASTM D2896 method. This BN is composed of two distinct forms:

- carbonate BN, provided by the overbasing of the detergent with metallic carbonates, generally calcium carbonate, hereafter referred to as "$BN_{CaCO3}$",
- so-called organic BN provided by the metallic soap of the detergent of an essentially phenate or salicylate or sulphonate type.

The carbonate BN, hereafter referred to as $BN_{CaCO3}$ is measured on the finished oil or the overbased detergents alone, according to the following procedure. The latter is based on the principle of attacking the (calcium) carbonate overbasing of the sample with sulphuric acid. This carbonate is converted to carbon dioxide according to the reaction;

$$CaCO_3 + H_2SO_4 \longrightarrow CaSO_4 + H_2O + CO_2 \uparrow$$

The volume of the reactor being constant, the pressure increases proportionally as $CO_2$ is released.

Figure 2:
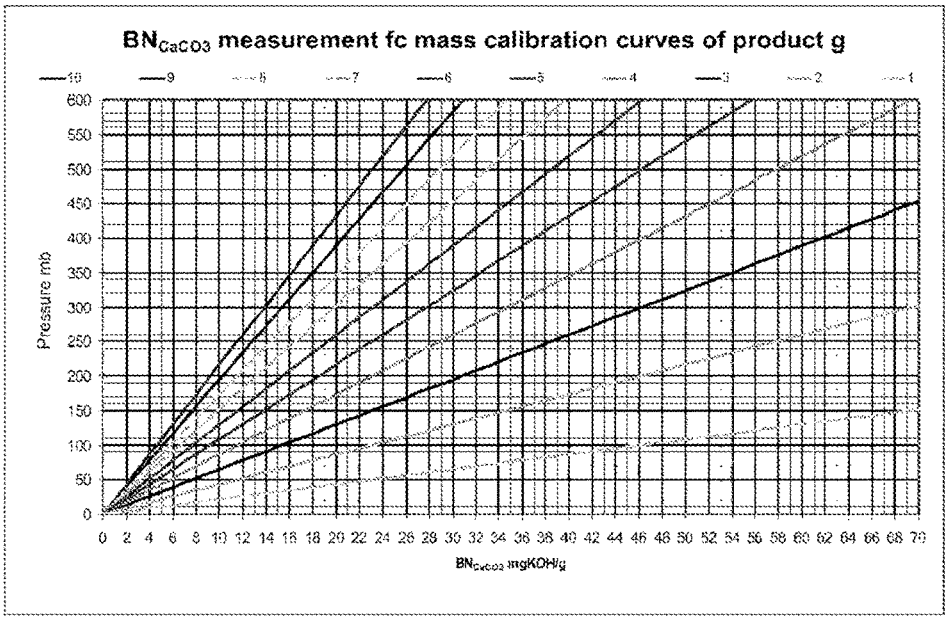
FIG. 2 is a graph showing pressure as a function of $BN_{caco3}$.

Procedure:

In a reaction vessel with a volume of 100 ml, equipped with a stopper on which a differential manometer is fitted, the necessary quantity of product the $BN_{CaCO3}$ of which is to be measured, is weighed so as not to exceed the measurement limit of the differential manometer, which is 600 mb of pressure increase. The quantity is determined from the graph in FIG. 2, indicating for each mass of product (1 to 10 grams, from right to left in the figure) the pressure measured on the differential manometer (which corresponds to the pressure increase due to the release of $CO_2$) as a function of the proportion of $BN_{CaCO3}$ in the sample. If the result of $BN_{CaCO3}$ is unknown, a moderate quantity of product of approximately 4 g is weighed. In all cases, the sample mass is noted (m).

The reaction vessel can be made of pyrex, glass, polycarbonate, etc. or any other material promoting heat exchanges with the ambient medium, such that the internal temperature of the vessel rapidly reaches equilibrium with that of the ambient medium. A small quantity of fluid base oil, of a SN 600 type, is introduced into the reaction vessel containing a small magnetic bar. Approximately 2 ml of concentrated sulphuric acid is introduced into the reaction vessel, taking care not to stir the medium at this stage.

The stopper and manometer assembly is screwed onto the reaction vessel. The screw threads can be lubricated. Tightening is carried out to ensure a complete seal.

Stirring is commenced, and continued for as long as necessary for the pressure to stabilize, and for the temperature to reach equilibrium with the ambient medium. A period of 30 minutes is sufficient. The increase in pressure P and ambient T° C. (σ) are noted. The assembly is cleaned with a heptane-type solvent.

Calculation Method

In order to calculate the pressure the perfect gas formula is used.

$$PV=nRT$$

P=Partial pressure of $CO_2$(Pa) (1 Pa=$10^{-2}$ mb)
V=Volume of the container ($m^3$).
R=8.32 (J).
T=273+σ(° C.)=(° K).
n=number of moles of $CO_2$ released $$PCO_2 = \frac{nCO_2 * R * T}{V} * 10^{-2}$$

Calculation of the Number of Moles of $CO_2$.

$$m^*\text{carbonate BN=mg KOH equivalent.}$$

m=mass of product in grams
carbonate BN=BN expressed in KOH equivalent per 1 g.

$$\frac{m * \text{carbonate } BN * \frac{44}{2 * 56.1}}{1000} = \text{g}$$

of $CO_2$ released, i.e. in number of moles of $CO_2$ released:

$$\frac{m * \text{carbonate } BN * 44 * 10^{-3}}{44 * 2 * 56.1} = m * \text{carbonate } BN * 0.0089\ 10^{-3}$$

Formula for Calculation of the Pressure of $CO_2$ as a Function of the Carbonate BN.

$$P\ CO_2 = \frac{m * \text{carbonate } BN * 0.0089\ 10^{-3} * R * T * 10^{-2}}{V}$$

Formula for Calculation of the Carbonate BN from the Pressure of $CO_2$.

$$\text{carbonate } BN = \frac{P * V}{m * 0.0089 * 10^{-3} * R * T * 10^{-2}}$$

By fixing the values linked to the test conditions, the simplified formula is obtained:

P $CO_2$=value read on the differential manometer, in mbars=P read
V=volume of the container in $m^3$=0.0001.
R=8.32 (J).
T=273+σ(° C.)=(° K). σ=Ambient temperature read.
m=mass of product introduced into the reaction vessel.

$$\text{carbonate } BN = \frac{P\ \text{read} * 0.0001}{m * 0.0089 * 10^{-3} * 8.32 * (273 * \sigma\text{read}) * 10^{-2}}$$

$$\text{carbonate } BN = \frac{P\ \text{read}}{m * 0.0074 * R * (273 * \sigma\text{read})}$$

The result obtained is the $BN_{CaCO3}$ expressed in mgKOH/g. The BN provided by the metallic soaps of detergents, also designated by "organic BN", is obtained by the difference between the total BN according to ASTM D2896 and the $BN_{CaCO3}$ thus measured.

Example 2

This example aims to describe the enthalpy test making it possible to measure the neutralization efficiency of the lubricants vis-à-vis sulphuric acid.

The availability or accessibility of the basic sites included in a lubricant, in particular a cylinder lubricant for a two-stroke marine engine, vis-à-vis the acid molecules, can be quantified by a dynamic test for monitoring the speed or kinetics of neutralization.

Principle:

The acid-base neutralization reactions are generally exothermic and it is therefore possible to measure the release of heat obtained by reaction of sulphuric acid on the lubricants to be tested. This release is monitored by the evolution of temperature over time in a DEWAR type adiabatic reactor.

Based on these measurements, it is possible to calculate an index quantifying the efficiency of a lubricant according to the present invention compared with a lubricant used as a reference, and for an added quantity of acid representing a fixed number of BN points to be neutralized. The BN of the lubricants to be tested is preferably in excess relative to the BN necessary to neutralize the quantity of acid added. In order to test BN 70 lubricants, in the examples which follow, a quantity of acid corresponding to the neutralization of 55 BN points is added.

The efficiency index is thus calculated with respect to the reference oil to which the value of 100 is assigned. This is the ratio between the neutralization reaction times of the reference ($S_{ref}$) and the measured sample ($S_{meas}$):

$$\text{Neutralization efficiency index}=S_{ref}/S_{meas}\times 100$$

The values of these neutralization reaction times, which are of the order of a few seconds, are determined from the acquisition curves of the increase in temperature as a function of time during the neutralization reaction. (See curve FIG. 1).

The duration S is equal to the difference $t_f - t_i$ between time at the temperature at the end of the reaction and time at the temperature at the start of the reaction. The time $t_i$ at the temperature at the start of the reaction corresponds to the first rise in temperature after stirring is started. The time $t_f$ at the temperature at the end of the reaction is the time from which the temperature signal remains stable for a duration greater than or equal to half the reaction time. The lubricant is all the more efficient as it leads to short neutralization times and therefore a high index.

Equipment Used:

The geometries of the reactor and of the stirrer as well as the operating conditions have been chosen so as to be within the chemical range, where the effect of the diffusional constraints in the oil phase is negligible. Therefore in the configuration of the equipment used, the depth of fluid must be equal to the internal diameter of the reactor, and the helical stirrer must be positioned approximately ⅓ of the way up the fluid.

The equipment is made up of a 300 ml adiabatic reactor of a cylindrical type, the internal diameter of which is 52 mm and the internal height 185 mm, with a stirring rod equipped with a helix with inclined blades, 22 mm in diameter; the diameter of the blades is comprised between 0.3 and 0.5 times the diameter of the DEWAR flask, i.e. 15.6 to 26 mm. The position of the helix is fixed at a distance of approximately 15 mm from the base of the reactor. The stirring system is driven by a 10 to 5,000 rpm variable speed motor and a temperature acquisition system as a function of time.

This system is suitable for measuring reaction times of the order of 5 to 20 seconds and for measuring the rise in temperature of a few tens of degrees starting from a temperature of approximately 20° C. to 35° C., preferably approximately 30° C. The position of the temperature acquisition system in the DEWAR flask is fixed. The stirring system is controlled in such a way that the reaction takes place within a chemical range: in the configuration of the present experiment, the rotation speed is adjusted to 2000 rpm, and the position of the system is fixed.

Moreover, the chemical range of the reaction is also dependent on the depth of oil introduced into the DEWAR flask, which must be equal to the diameter of the flask, and which corresponds in the context of this experiment to a mass of approximately 86 g of the lubricant tested. In order to test BN 70 lubricants, a quantity of acid corresponding to the neutralization of 55 BN points is here introduced into the reactor. 4.13 g of 95% concentrated sulphuric acid and 85.6 g of lubricant to be tested are introduced into the reactor, for a BN 70 lubricant.

After placing the stirring system inside the reactor so that the acid and the lubricant mix well and in a reproducible manner between two tests, stirring is started in order to monitor the reaction within a chemical range. The acquisition system is permanent.

Implementation of the Enthalpy Test—Calibration:

In order to calculate the efficiency indices of the lubricants according to the present invention using the method described above, we chose to take as a reference the neutralization reaction time measured for a BN 70 two-stroke marine engine cylinder oil (measured according to ASTM D-2896), comprising no fatty amines according to the present invention. This oil is obtained from a mineral base obtained by mixture of a distillate with a density at 15° C. comprised between 880 and 900 Kg/m$^3$ with a distillation residue with a density comprised between 895 and 915 Kg/m$^3$ (Bright stock) in a distillate/residue ratio of 3.

A concentrate containing an overbased calcium sulphonate with a BN equal to 400 mg KOH/g, a dispersant, and an overbased calcium phenate with a BN equal to 250 mg KOH/g is added to this base. This oil is formulated specifically to have a neutralization capacity sufficient to be used with fuels with a high sulphur content, namely S contents greater than 3% or even 3.5%.

The reference lubricant contains 25.50% by mass of this concentrate. Its BN of 70 is provided exclusively by the overbased detergents (overbased phenates and sulphonates) contained in said concentrate. This reference lubricant has a viscosity at 100° C. comprised between 18 and 21.5 mm$^2$/s. The neutralization reaction time of this oil (hereafter reference Href) is 10.59 seconds and its neutralization efficiency index is fixed at 100.

Example 3

Lubricating Compositions

Several lubricating compositions were prepared from the following compounds:

- Group I base oils, in order to confer a KV100 of the order of 20 cSt and a KV40 of the order of 225 to 240 cSt on the compositions.
- Neutral phenate detergent
- Overbased phenate detergent
- Overbased sulphonate detergent
- Ethoxylated oleic monoamine
- Oleyl propylene diamine (non-ethoxylated)
- Fatty alcohol (mixture of C16 to C18 fatty monoalcohols with fatty chains)

For each of the compositions prepared, the total BN was measured according to ASTM D-2896, the Carbonate BN according to the method described in Example 1, the neutralization efficiency index according to the method described in Example 2. The anti-wear properties of these compositions were also measured by the Falex wear test (measurement of wear in μm): the lower the wear score, the better the anti-wear properties.

This test uses a Falex brand tribometer with pin and blocks. The lubricant to be tested is placed in a container heated to the desired temperature. The blocks are placed in the gap between the jaws and the pin fixed on the chuck. The pin-block assembly is submerged in an oil bath. A fixed load (3760 N in our case) is applied to the pin-block assembly via the jaws and a pneumatic cylinder. The pin is rotated at a fixed speed. A distance detector situated on the cylinder constantly measures the distance between the jaws and thus the wear of the pin and of the blocks. This wear is recorded and the final wear result reported as the test result.

The thermal behaviour of these compositions was also measured by the continuous ECBT test, where the mass of deposits (in mg) generated under determined conditions is measured. The lower this mass, the better the thermal behaviour.

This test makes it possible to simulate both the thermal stability and the detergency of the marine lubricants. The test utilizes aluminium beakers which are similar to pistons in shape. These beakers are placed in a glass container, maintained at a controlled temperature of the order of 60° C. The lubricant is placed in these containers, themselves equipped with a metallic brush, partially submerged in the lubricant. This brush is rotated at a speed of 1000 rpm, spraying lubricant over the inner surface of the beaker. The beaker is maintained at a temperature of 310° C. by an electric resistive heater, regulated by a thermocouple.

In the procedure used, called continuous ECBT, the test takes 12 hours and the spraying of lubricant is continuous. This procedure simulates the formation of deposits in the piston-segment assembly. The result is the weight of deposits measured on the beaker. A detailed description of this test is given in the publication entitled "Research and Development of Marine Lubricants in ELF ANTAR France—The relevance of laboratory tests in simulating field performance" by Jean-Philipppe ROMAN, MARINE PROPULSION CONFERENCE 2000—AMSTERDAM—29-30 Mar. 2000.

The compositions B, F, G and H are compositions according to the invention, the BN of which is of the order of 43 to 44. It is noted that their neutralization efficiency is identical to or even greater than that of the reference, a BN 70 cylinder oil which can be used with fuels having high sulphur contents. Thus, the compositions according to the invention can for example be used as cylinder oil for 2-stroke marine engines, with fuels the content of which is of the order of 4.5% m/m. The reduction in the overbased detergents content (and therefore insoluble metallic salts content) thus made possible also allows their use as cylinder oil for 2-stroke marine engines, with fuels the content of which is low, of the order of 1.5% m/m and less.

Compared with the compositions A and C, which contain no alkoxylated amine, it is noted that the wear properties of the compositions according to the invention are greatly improved. In the compositions D and E, where the provision of BN by the amines is high (of the order of 10 to 15 BN points), a degradation in the thermal behaviour is noted compared with the compositions according to the invention. In the compositions I, J and K, where the percentage of BN provided by the carbonates is high (of the order of 70% and beyond), a degradation in the thermal behaviour is also noted compared with the compositions according to the invention. Thus the compositions according to the invention have the advantage of a neutralization efficiency allowing them to be used with both high- and low-sulphur fuels, while having improved anti-wear properties and thermal behaviour.

Example 4

Example 3 was repeated under the same experimental conditions but with other lubricant compositions according to the invention. These lubricant compositions are prepared from the following compounds:

- A mixture of Group I and Group II base oils, in order to confer a KV100 of the order of 20 cSt and a KV40 of the order of 225 to 240 cSt on composition L,
- A neutral carboxylate detergent (composition M),
- A mixture of overbased phenate and carboxylate detergents (composition N),
- A bis(2-hydroxyethyl)cocoalkylamine (composition O), in the proportions in Table 2 below,
- The neutral phenate detergents used in compositions L, N and O are the same as those used in Example 3,
- The overbased phenate and sulphonate detergents used in compositions L, M, O are the same as those used in Example 3,
- The ethoxylated oleic monoamine used in compositions L, M and O is the same as that used in Example 3.

It is noted that the lubricant compositions L to O according to the invention exhibit good neutralization efficiency, good anti-wear properties and thermal behaviour irrespective of the base oil used (composition L), the neutral detergent used (composition M), the overbased detergent used (composition N) or the ethoxylated amine used (composition O).

TABLE 2

Lubricant compositions and properties (continued)

| | L | M | N | O |
|---|---|---|---|---|
| Neutral phenate detergents | 5.80 | — | 5.80 | 5.80 |
| Neutral carboxylate detergents | — | 6.20 | — | — |

TABLE 1

Lubricating compositions and properties

| | A | B | C | D | E | F | G | H | I | J | K |
|---|---|---|---|---|---|---|---|---|---|---|---|
| Neutral detergents | 1.90 | 1.90 | 1.90 | 1.90 | 1.90 | 7.70 | 3.85 | 5.80 | 0.00 | 2.80 | 0.00 |
| Overbased detergents | 13.65 | 13.65 | 13.65 | 13.65 | 13.65 | 9.20 | 11.10 | 11.40 | 10 | 8.60 | 12.70 |
| Ethoxylated amine*** | — | 3.00 | | 6.20 | 9.00 | 3.00 | 3.00 | 3.00 | 3.00 | 3.00 | 3.00 |
| Fatty diamine**** | — | | 3.15 | | | | | | | | |
| Dispersant | 1.20 | 1.20 | 1.20 | 1.20 | 1.20 | 1.20 | 1.20 | 1.20 | 1.20 | 1.20 | 1.20 |
| Anti-foaming agent | 0.04 | 0.04 | 0.04 | 0.04 | 0.04 | 0.04 | 0.04 | 0.04 | 0.04 | 0.04 | 0.04 |
| C16-C18 fatty alcohol | 0.50 | | | | | | | | | | |
| Group I bases | | 80.21 | 80.06 | 77.01 | 74.21 | 78.86 | 80.81 | 78.56 | 85.76 | 84.36 | 83.06 |
| Total | 100 | 100 | 100 | 100 | 100 | 100 | 100 | 100 | 100 | 100 | 100 |
| Total BN ASTM D-2896 | 43.8 | 43.5 | | | | 43.3 | 44.2 | 43.8 | 44.8 | 43.4 | 43.1 |
| BN $CaCO_3$* | 26.7 | 25.7 | | | | 24.1 | 25.6 | 22.4 | 37.1 | 32.7 | 29.5 |
| % $BNCaCo_3$/total BN | 62% | 59% | | | | 56% | 58% | 51% | 83% | 75% | 68% |
| Neutralization efficiency index** | 105 | 101 | | | | 103 | 101 | 114 | 100 | 101 | 115 |
| Falex wear (μm) | 58 | 18 | 55 | 19 | 23 | 19 | 17 | 19 | | | |
| ECBT deposit (mg) | 213 | 167 | | 191 | 334 | 148 | 158 | 122 | 334 | 256 | 248 |

*Measurement according to the method described in Example 1

**Measurement according to the method described in Example 2

***BN 160

****BN 320

TABLE 2-continued

| Lubricant compositions and properties (continued) | | | | |
|---|---|---|---|---|
| | L | M | N | O |
| Overbased phenate and sulphonate detergents | 11.40 | 11.40 | — | 11.40 |
| Overbased phenate and carboxylate detergents | — | — | 11.60 | — |
| Ethoxylated amine ethoxylated oleic monoamine *** | 3.00 | 3.00 | 3.00 | — |
| Ethoxylated amine bis (2-hydroxyethyl) cocoalkylamine**** | — | — | — | 2.45 |
| Dispersant | 1.20 | 1.20 | 1.20 | 1.20 |
| Anti-foaming agent | 0.04 | 0.04 | 0.04 | 0.04 |
| Group I bases | — | 78.16 | 78.36 | 79.11 |
| Group I and II bases | 78.56 | | — | — |
| Total | 100 | 100 | 100 | 100 |
| Total BN ASTM D-2896 | 43.6 | 44.2 | 43.8 | 43.9 |
| BN $CaCO_3$* | 26.7 | 27.0 | 26.7 | 27.4 |
| % BN$CaCo_3$/total BN | 61.2 | 61.1 | 61.0 | 62.4 |
| Neutralization efficiency index ** | 111 | 144 | 123 | 134 |
| Falex wear (μm) | 28 | 33 | 21 | 27 |
| ECBT deposit (mg) | 121 | 99 | 105 | 103 |

*Measurement according to the method described in Example 1
** Measurement according to the method described in Example 2
*** BN 160 mgKOH/g
****BN 196 mg KOH/g

The invention claimed is:

1. A cylinder lubricant for a two-stroke marine engine having a BN determined according to the standard ASTM D-2896 greater than or equal to 15 milligrams of potash per gram of lubricant, comprising:

(a) one or more lubricant base oils for marine engines;

(b) at least one detergent based on alkali or alkaline-earth metals, overbased with metallic carbonate salts;

(c) at least one neutral detergent; and (d) one or more oil-soluble alkoxylated fatty amines, and having a BN determined according to the standard ASTM D-2896 comprised between 100 and 600 milligrams of potash per gram;

where the percentage by mass of alkoxylated fatty amines with respect to the total weight of lubricant is chosen such that the BN provided by these compounds represents a contribution comprised between 2 and 7 milligrams of potash per gram of lubricant; and where the BN provided by the metallic carbonate salts represents a contribution of at the most 65% of the total BN, measured according to the standard ASTM D2896, of the cylinder lubricant.

2. The cylinder lubricant according to claim 1 wherein the BN of the alkoxylated fatty amines determined according to the standard ASTM D-2896 is comprised between 120 and 500 milligrams of potash per gram.

3. The cylinder lubricant according to claim 1 wherein the percentage by mass of alkoxylated fatty amines with respect to the total weight of lubricant is chosen such that the BN provided by these compounds represents a contribution comprised between 3 and 7 milligrams of potash per gram of lubricant with the total BN of said cylinder lubricant, determined according to the standard ASTM D-2896.

4. The cylinder lubricant according to claim 1 having a BN, determined according to the standard ASTM D-2896, greater than or equal to 20 milligrams of potash per gram of lubricant.

5. The cylinder lubricant according to claim 1 having a BN, determined according to the standard ASTM D-2896, less than 55 milligrams of potash per gram of lubricant.

6. The cylinder lubricant according to claim 1 having a BN, determined according to the standard ASTM D-2896, comprised between 40 and 50 milligrams of potash per gram of lubricant.

7. The cylinder lubricant according to claim 1 having a BN, determined according to the standard ASTM D-2896, comprised between 50 and 55 milligrams of potash per gram of lubricant.

8. The cylinder lubricant according to claim 1 wherein the BN provided by the metallic carbonate salts represents a contribution comprised between 10% and 60% of the total BN of the cylinder lubricant.

9. The cylinder lubricant according to claim 1 in which the oil-soluble alkoxylated fatty amine(s) are obtained from palm, olive, peanut, standard or oleic rapeseed, standard or oleic sunflower, soya or cotton oil, from beef tallow, or from palmitic, stearic, oleic or linoleic acid.

10. The cylinder lubricant according to claim 1 in which the oil-soluble alkoxylated fatty amine(s) are obtained from fatty acids comprising between 16 and 18 carbon atoms.

11. The cylinder lubricant according to claim 1 in which the alkoxylated fatty amine(s) correspond to general formula (I):

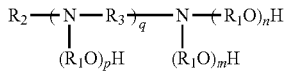

(I)

where $R_1$ is an ethylene, propylene, butylene radical, $R_2$ is a fatty chain of saturated or unsaturated fatty acids, comprising between 12 and 22 carbon atoms, preferably between 16 and 18 carbon atoms, $R_3$ is an alkylene radical comprising between 2 and 3 carbon atoms, q is equal to 0 or to 1, and when q is equal to zero, p is equal to zero, n, m and p are integers comprised between 0 and 12, and n+m+p is strictly greater than zero.

12. The cylinder lubricant according to claim 11 wherein:

q=p=0, m+n is comprised between 2 and 5, and m and n are non-zero.

13. The cylinder lubricant according to claim 1 in which the overbased detergents (b) and the neutral detergents (c) are chosen from the carboxylates, sulphonates, salicylates, naphthenates, phenates, and mixed detergents combining at least two of these types of detergents.

14. The cylinder lubricant according to claim 1 wherein at least one overbased detergent (b) is a sulphonate.

15. The cylinder lubricant according to claim 1 wherein at least one neutral detergent (c) is a phenate or a sulphonate.

16. The cylinder lubricant according to claim 1 also comprising from 0.1 to 10% by mass, of one or more compounds chosen from:

the primary, secondary or tertiary fatty monoalcohols, the alkyl chain of which is saturated or unsaturated, linear or branched, and comprise at least 12 carbon atoms; and the esters of saturated fatty monoacids comprising at least 14 carbon atoms and alcohols comprising at the most 6 carbon atoms.

17. The cylinder lubricant according to claim 1, the kinematic viscosity of which measured according to the standard ASTM D445 at 100° C. is comprised between 12.5 and 26.1 cSt.

18. A method for lubricating a two-stroke marine engine powered with a fuel oil comprising operating the engine with a cylinder lubricant according to claim 1, wherein the lubricant can be used both with fuel oils with a sulphur content less than 1.5% m/m and with fuel oils with a sulphur content greater than 3.5% m/m.

19. A method for lubricating a two-stroke marine engine powered with a fuel oil comprising operating the engine with a cylinder lubricant according to claim 1, wherein the lubricant can be used with all the fuel oils with a sulphur content comprised between 0.1% m/m and 3.5% m/m.

20. A method for preventing corrosion and/or reducing the formation of insoluble metallic salt deposits in the cylinders of a two-stroke marine engine powered with a fuel oil the sulphur content of which is less than 4.5% m/m, comprising operating the engine with a cylinder lubricant according to claim 1.

21. A concentrate of additives, for the preparation of cylinder lubricants having a BN determined according to the standard ASTM D-2896 greater than or equal to 15 milligrams of potash per gram of lubricant, the concentrate having a BN comprised between 180 and 250, and comprising one or more alkoxylated fatty amines with a BN comprised between 100 and 600 mg of potash/g of amine according to the standard ASTM D-2896, the percentage by mass of the alkoxylated fatty amines in the concentrate being chosen so as to provide the concentrate with a contribution of BN determined according to the standard ASTM D-2896 comprised between 10 and 40 milligrams of potash per gram of concentrate.

22. A cylinder lubricant for a two-stroke marine engine having a BN determined according to the standard ASTM D-2896 greater than or equal to 15 milligrams of potash per gram of lubricant, comprising:

(a) from 78% (weight) to 81% (weight) group I base oils for marine engines;

(b) from 9% (weight) to 14% (weight) phenate and sulphonate detergents overbased with metallic carbonate salts;

(c) from 1% (weight) to 8% (weight) neutral phenate detergent;

(d) 3% (weight) ethoxylated oleic monoamine;

(e) 1.2% (weight) dispersant; and (f) 0.04% (weight) anti-foaming agent, where the percentage by mass of ethoxylated oleic monoamine with respect to the total weight of lubricant is such that the BN provided by these compounds represents a contribution comprised between 3.5 and 5 milligrams of potash per gram of lubricant.

* * * * *